US010391021B2

(12) United States Patent
Fuster

(10) Patent No.: US 10,391,021 B2
(45) Date of Patent: Aug. 27, 2019

(54) MASSAGE HEAD AND MASSAGE APPARATUS USING SUCH A HEAD

(71) Applicant: LPG SYSTEMS, Valence (FR)

(72) Inventor: Arnaud Fuster, Beaumont les Valence (FR)

(73) Assignee: LPG Systems, Valence (FR)

( * ) Notice: Subject to any disclaimer, the term of this patent is extended or adjusted under 35 U.S.C. 154(b) by 309 days.

(21) Appl. No.: 15/306,872

(22) PCT Filed: Apr. 17, 2015

(86) PCT No.: PCT/FR2015/051043
§ 371 (c)(1),
(2) Date: Oct. 26, 2016

(87) PCT Pub. No.: WO2015/185814
PCT Pub. Date: Dec. 10, 2015

(65) Prior Publication Data

US 2018/0071165 A1 Mar. 15, 2018

(30) Foreign Application Priority Data

Jun. 6, 2014 (FR) ..... 14 55163

(51) Int. Cl.
*A61H 7/00* (2006.01)
*A61H 15/00* (2006.01)

(52) U.S. Cl.
CPC ..... *A61H 15/0085* (2013.01); *A61H 7/005* (2013.01); *A61H 7/007* (2013.01);
(Continued)

(58) Field of Classification Search
CPC ..... A61H 7/001; A61H 7/003; A61H 7/005; A61H 7/007; A61H 7/008; A61H 15/00;
(Continued)

(56) References Cited

U.S. PATENT DOCUMENTS 5,961,475 A * 10/1999 Guitay ..... A61H 9/005 601/126
6,419,650 B1 * 7/2002 Ryan ..... A61H 15/00 601/122

(Continued)

FOREIGN PATENT DOCUMENTS

CN 101904794 A 12/2010
EP 0917452 B1 7/2003

(Continued)

OTHER PUBLICATIONS

International Search Report issued in PCT/FR2015/051043 dated Sep. 9, 2015.

*Primary Examiner* — LaToya M Louis
(74) *Attorney, Agent, or Firm* — Marshall, Gerstein & Borun LLP

(57) ABSTRACT

A casing defining an internal chamber having a skinfold formed therein when it is applied to a patient's skin, said fold coming into contact with the lower edges of the chamber. The chamber is defined by two lateral walls and by two transverse walls, at least one of said transverse walls being formed of a flap capable of having a pivoting motion, to induce the coming closer and the drawing away from each other of the lower edges of said transverse walls in contact with the skinfold. The flap is hinged in the vicinity of its upper end on the lateral walls. The pivoting of the flap is obtained by means of a geared motor fixedly assembled within said flap, and having its output shaft rotating a cam, received in a cam race fastened to one of the lateral walls of the internal chamber.

8 Claims, 6 Drawing Sheets

(52) U.S. Cl.
CPC ..... *A61H 7/008* (2013.01); *A61H 7/001* (2013.01); *A61H 2007/009* (2013.01); *A61H 2201/0153* (2013.01); *A61H 2201/1215* (2013.01); *A61H 2201/1463* (2013.01); *A61H 2201/1654* (2013.01); *A61H 2205/02* (2013.01)

(58) Field of Classification Search
CPC ..... A61H 15/0085; A61H 39/04; A61H 2205/067
See application file for complete search history.

(56) References Cited

U.S. PATENT DOCUMENTS 6,585,667 B1 * 7/2003 Muller ..... A61H 7/008 601/6
7,634,314 B2 * 12/2009 Applebaum ..... A61H 15/0085 601/20
8,864,690 B2 * 10/2014 Fuster ..... A61H 7/005 601/103
9,011,356 B2 * 4/2015 McClorey ..... A61H 15/00 601/122

FOREIGN PATENT DOCUMENTS

FR 2809952 A1 12/2001
FR 2902318 A1 12/2007

* cited by examiner

MASSAGE HEAD AND MASSAGE APPARATUS USING SUCH A HEAD

TECHNOLOGICAL FIELD

The present invention relates to an advanced massage head, intended for mobilizing the skin tissue.

It also relates to a massage apparatus using such a head.

The presently described embodiments aim at the performing in a simple and efficient manner of massaging operations, on human beings as well as on animals, particularly tending to optimize the mechanical stimulation of said skin tissue during the pinching operation.

BACKGROUND

Different massaging techniques are know, their implementation depending on the treatments to be performed. Generally, such techniques aim at exerting on the patient actions using pressure and/or pinching phenomena on skin tissue.

A large number of devices have been provided to make the practitioner's action easier. Among such devices, the use of apparatuses using a simple mechanical action, for example, by means of assemblies comprises balls assembled on a casing, possibly enabling to distribute or to simultaneously apply a cream or gel-type treatment product such as for example described in document FR A 1 225 094, has first been provided.

It has also been provided to replace this mechanical treatment with a treatment of suction of the patient's skin. To achieve this, the concerned massaging apparatuses use a treatment head connected to a suction circuit, said treatment head being formed of a casing defining an internal chamber having the suction circuit emerging into it. When the massage head is applied against the patient's body, and due to the suction generated by the suction circuit, a skinfold forms within the internal chamber, which skinfold bears against the peripheral edge of said internal chamber. The mechanical action may be exerted by rollers or balls which enable to exert, simultaneously to the suction on the patient's body, a pressure and/or displacement and/or friction action, particularly by vibration.

The solutions provided in this context result in complex assemblies, which are difficult to form, and which are not fully satisfactory in terms of results.

Massage apparatuses capable of simply reproducing subdermal-tissue-type massages, that is, comprising a continuous action on the patient, causing not only a local pinching of the skin tissue, but also a progressive displacement of the pinched area to cause a rolling of said skinfold and, this, while exerting a pressure (see, for example, EP-A-0 224 422), have already been provided.

The apparatuses described, for example, in this document, comprise a manually-actuatable casing having two parallel rollers, assembled to freely rotate or positively rotated with the casing, assembled therein. The rollers may be assembled on the casing with a fixed center-to-center distance, or are, conversely, capable of automatically moving away and coming closer to each other during the massage operation, said casing being itself connected to suction means enabling to create a depression between said rollers when the head fitted with these different elements is applied against the patient's body, to form a skinfold bearing against the roller surface.

In document EP 0 917 452, it has been provided to replace the rollers with two partition walls placed inside of the casing, hinged inside of it to be able to have a pivoting motion, said casing being, here again, connected to a suction source. Under the action of the suction, a skinfold is created, which inserts between the two partition walls inside of the casing. Due to the progress in one direction or the other of the massage head fitted with such a device against the patient's skin, the skinfold thus formed is submitted to a jerky pinching.

In the absence of action, the two partition walls are maintained spaced apart from each other, for example, by means of springs or of magnets, the pivoting of said partition walls and thus their coming together resulting from the effect of vacuum and/or of the depression generated inside of the casing.

Although such a device is satisfactory, there however appears that, due to unavoidable leaks between the lower edge of the casing and the patient's skin against which it applies, the vacuum or the depression may be rapidly broken, thus affecting the efficiency of the treatment, and particularly the pinching action resulting from the two partition walls. Further, it is not unusual, due to the depression generated within the internal chamber of the casing, to have a jamming of one or of both partition walls, thus more significantly affecting the treatment efficiency.

As a result, the tangential stimulation of the skinfold resulting from the action of the lower edge of said partition walls or flaps is thus insufficient, and the desired pinching does not systematically have the desired efficiency.

The object of the presently described embodiments thus is to optimize the mechanical stimulation inherent to the pinching.

SUMMARY OF THE SPECIFICATION

For this purpose, the present description is directed to a massage head comprising a casing defining an internal chamber having a skinfold formed therein when it is applied to a patient's skin, said fold coming into contact with the lower edges of the chamber, said chamber being defined by two lateral walls and by two transverse walls, at least one of said transverse walls being formed of a flap capable of having a pivoting motion, to induce the coming closer and the drawing away from each other of the lower edges of said transverse walls in contact with the skinfold.

In an embodiment, the flap is hinged in the vicinity of its upper end on the lateral walls.

Further, the pivoting of the flap is obtained by means of a geared motor fixedly assembled within said flap, and having its output shaft rotating a cam, received in a cam race fastened to one of the lateral walls of the internal chamber.

In other words, the described embodiments comprise motorizing the action of the flap(s), and thus no longer making the coming closer or the drawing away of the lower edges of the flap(s) from each other dependent on the sole action of vacuum, to provide, whatever the circumstances, an effective pinching of the skinfold. The skinfold thus results from the mechanical catching generated by the free lower edge of said flaps. To achieve this, the latter are advantageously coated with a material having a high friction coefficient, such as for example an elastomer.

Thereby, the so-called "Jacquet pinching" technique, comprising performing successive pressures into the entire skin depth and in all directions, is efficiently reproduced.

The implementation of the mechanical actuation of the flap(s) to form the skinfold has the advantage of guaranteeing the returning of the flaps to their original position, conversely to prior art devices which only implement a suction, capable, as reminded hereabove, of resulting in the adhesion of said flaps together, preventing any pinching action of the massage head.

The lateral wall opposite to that receiving the cam races may receive an electronic board connected to a connector, accessible at the level of the upper end of said lateral wall. Thereby, it is possible to convey to the level of this connector the electric power necessary to generate the operation of the geared motor integrated within said flap.

According to another feature, the massage head is formed of two modules, provided with means capable of enabling to reversibly fasten them to each other. Thereby, in addition to the optimized accessibility inside of the internal chamber that they define, and as a corollary, to the possibility of changing the parts of the head, it is also possible to perform an optimized cleaning of the different components thereof.

According to another feature, the massage head receives a sealing shutter in the upper portion of the internal chamber, capable of lodging itself in housings provided for this purpose. Thereby, the efficiency of the massage head is optimized by the double action of the pinching inherent to the flaps, on the one hand, and of the depression generated within the chamber, on the other hand, when the latter is effectively connected to a suction source.

The described embodiments also relate to a massage device using such a massage head. The massage device comprises a power source capable of actuating the geared motor integrated in the flap(s) of the massage head. The massage device is also capable of comprising a vacuum or depression source associated with the massage head, and emerging into it.

BRIEF DESCRIPTION OF THE DRAWINGS

Various implementations and the resulting advantages will better appear from the following non-limiting embodiments, in relation with the accompanying drawings.

DETAILED DESCRIPTION

Figure 1:
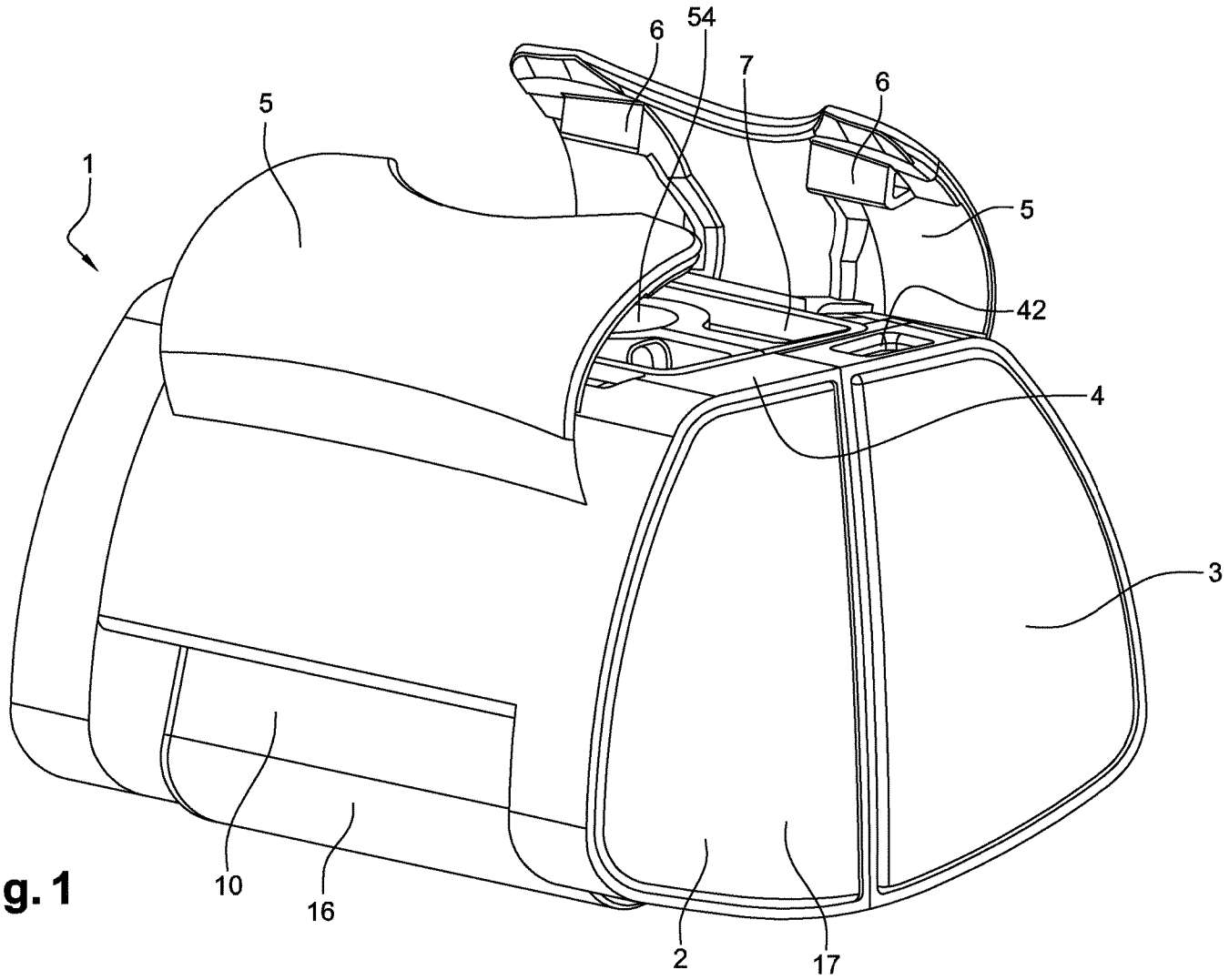
FIG. 1 is a simplified perspective representation of the massage head.
Figure 2:
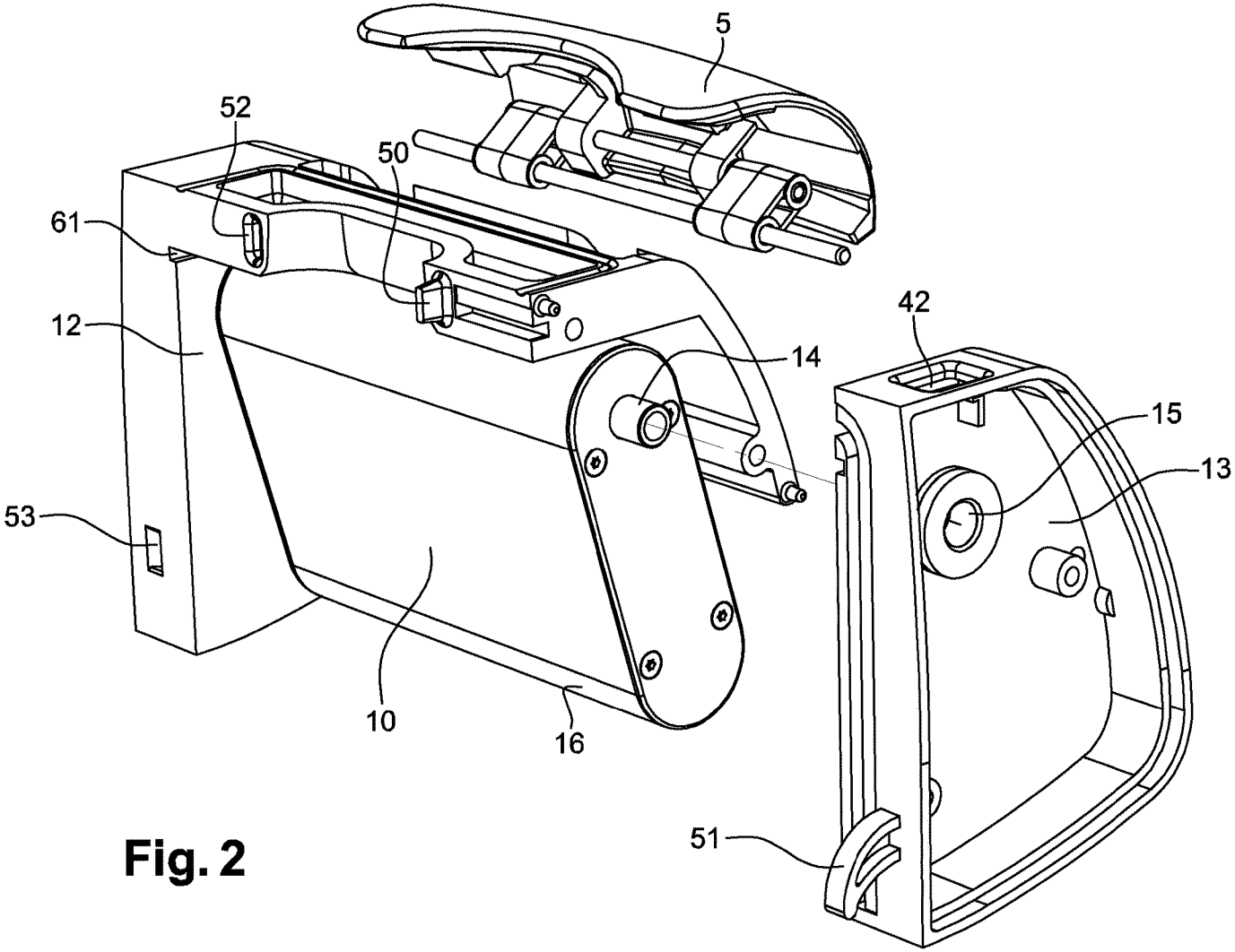
FIG. 2 is a simplified exploded perspective view of a module forming part of the massage head, seen from one of the sides thereof.

A simplified view of massage head 1 has thus been illustrated in relation with FIG. 1.

It is formed by fastening together two modules 2, 3, said fastening being advantageously reversible.

The modules define, when they are associated with each other, an internal chamber inside of which a skinfold is formed.

The internal chamber is itself defined by two lateral walls, by two transverse walls, in addition to a back wall 4. The surface opposite to the back wall is open, precisely to enable the forming of the skinfold inside of the internal chamber.

The massage head is also provided with hoods 5, hinged in the vicinity of the upper portion of the transverse walls, and intended to form parts for locking the modules together and, further, on the upper portion of the massage head (not shown).

Hoods 5 are each provided with projections 6, intended to fit into corresponding recesses 7, provided for this purpose at the level of the back wall, to promote the fastening of the two modules together, on the one hand, and to the upper portion of the massage head, on the other hand.

This fastening is besides described in the patent application filed simultaneously to the present application, and more particularly aiming at the modular character of the massage head.

According to an embodiment, the massage head comprises at least one flap 10 hinged in the vicinity of its upper end on lateral walls 12 and 13 of one of modules 2, 3 defining the massage head. In other words, said flap forms part at least of the above-mentioned transverse wall.

To achieve this, flap 10 comprises a swivel axis 14, having its two ends received in a housing 15 formed at the level of each of the two lateral surfaces 12 and 13.

Flap 10 has a height substantially corresponding to that of the internal chamber defined by the massage head. It however slightly protrudes beyond the lower end of the lateral walls to optimize the pinching action.

Flap 10 has a rounded lower edge 16, advantageously coated with an elastomer material to optimize the friction and, as a corollary, the pinching action when the massage head is in contact with the patient's skin.

Figure 3:
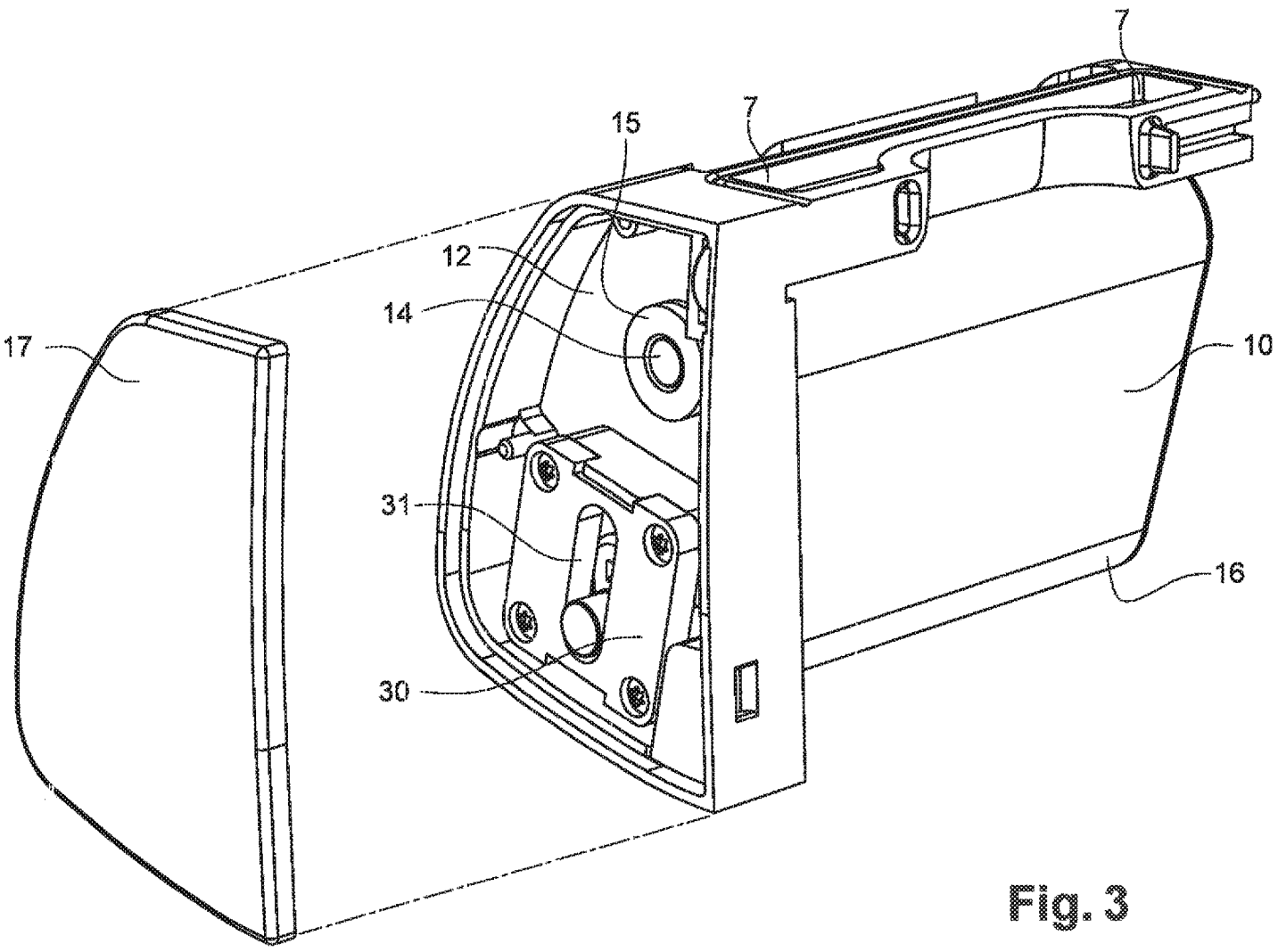
FIG. 3 is a simplified exploded perspective view of said module seen from the other side.
Figure 4:
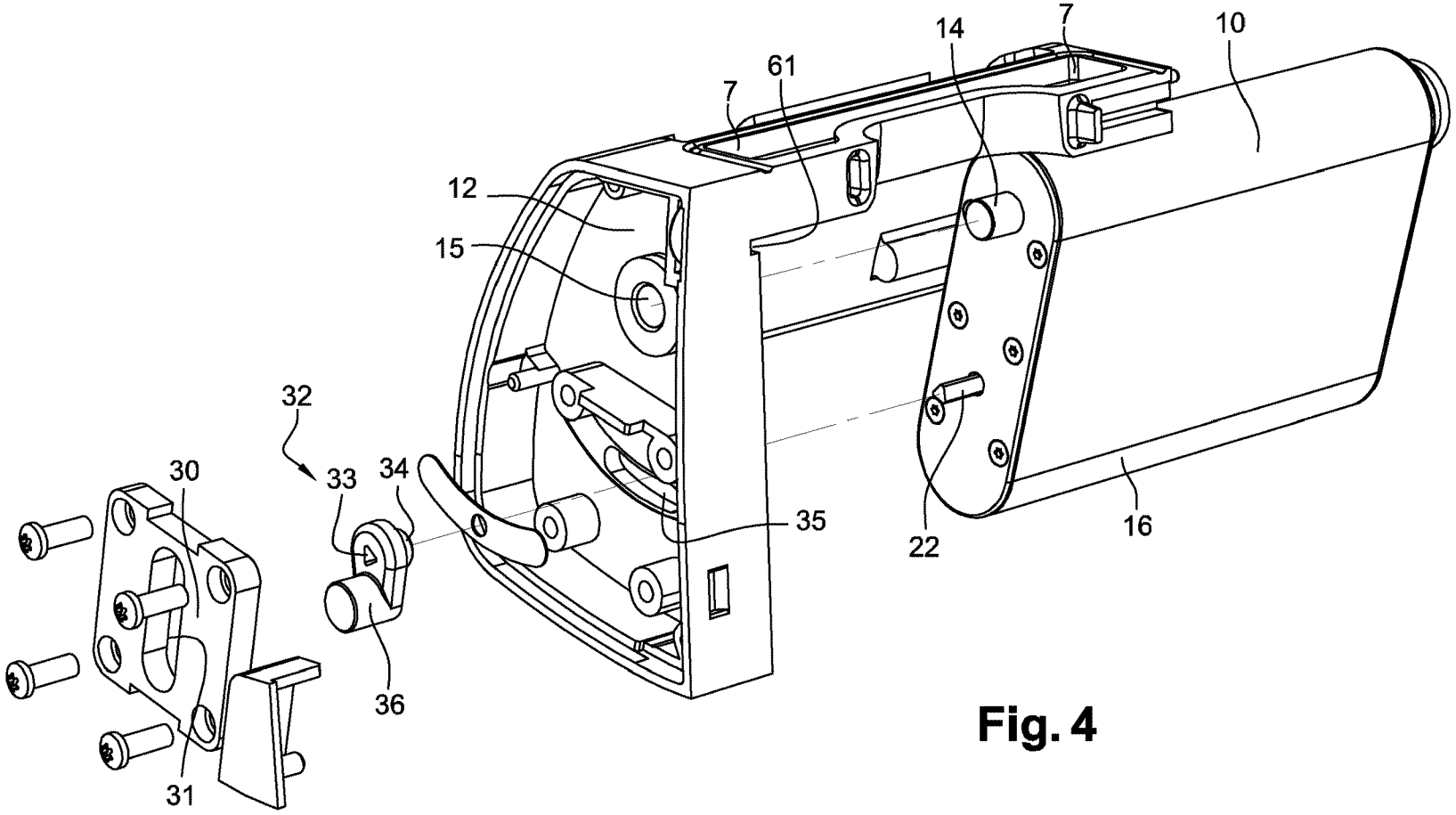
FIG. 4 is a detailed view of FIG. 3.

Lateral walls 12 and 13 have an internal volume enabling to respectively receive, on the one hand, an electronic circuit, having a function which will be described hereafter, and on the other hand, a cam race as illustrated in FIGS. 3 and 4. This volume is closed by a plate 17 (see FIG. 3) and 18 (see FIG. 6) to protect the elements contained in said volumes. Plates 17 and 18 are simply and quite conventionally mechanically snapped on the periphery.

Figure 5:
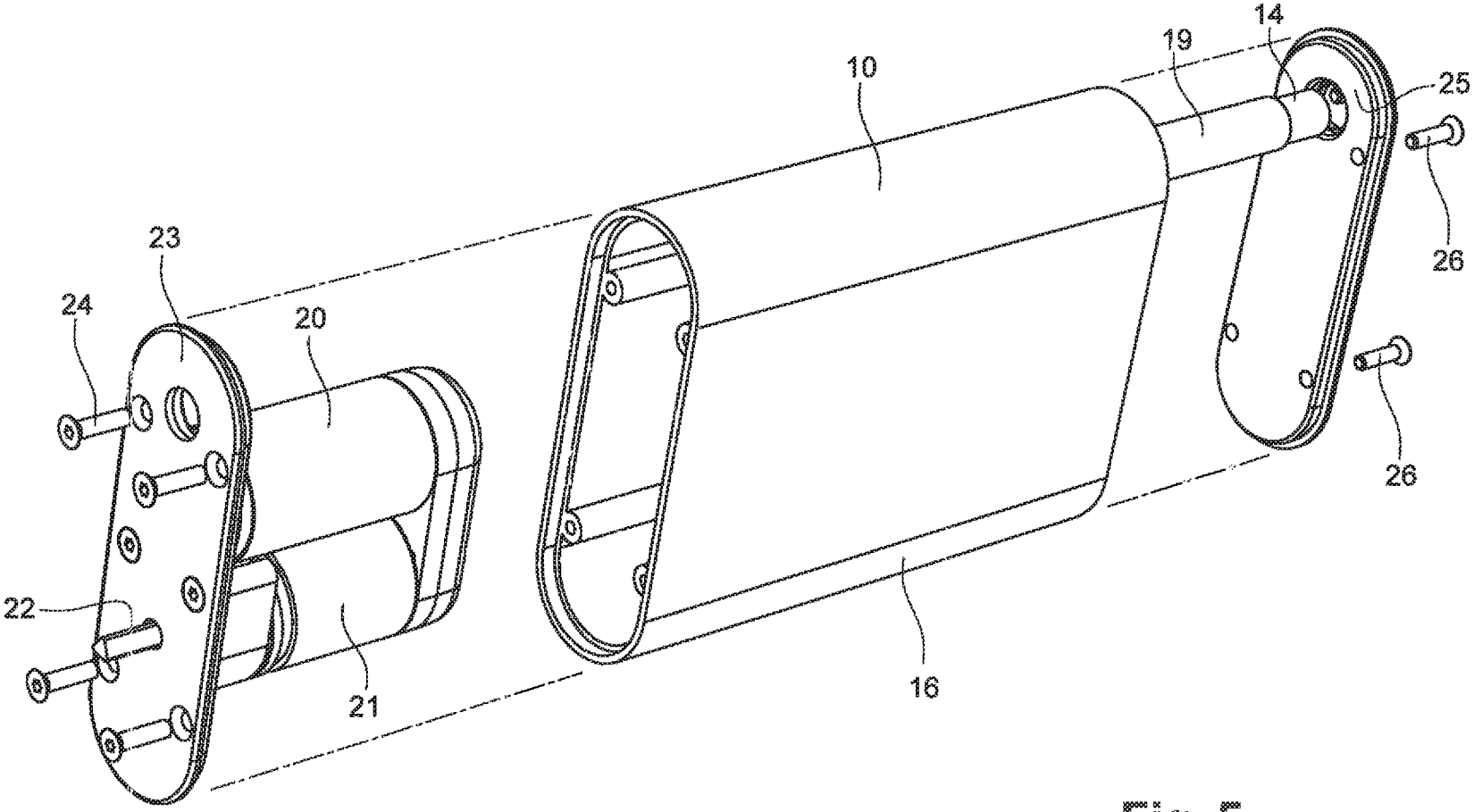
FIG. 5 is a simplified representation of the flap forming the massage head in exploded view.

An exploded view of flap 10 has been shown in relation with FIG. 5. It has a race-track shaped transverse cross-section. The volume thus defined receives a motor 20 actuating a gear reducer 21, reference 22 designating the output shaft of reducer 21. Actually, the couple formed of motor 20 and reducer 21 is fastened to a lateral plate 23, for example fastened by means of screws 24 to one of the walls of flap 10. Another plate 25 closes the other wall of the flap, and is also fastened thereto by means of screws 26.

FIG. 3 shows a first view of lateral wall 12 integrating mechanical elements capable of allowing, in cooperation with geared motor 20, 21, the pivoting of flap 10. More specifically, FIG. 3 shows a cam race 30 here formed of a rectilinear port 31.

FIG. 4 more specifically shows the different mechanical elements allowing the pivoting of said flap 10. Thus, output shaft 22 of reducer 21, in the case in point having a triangular cross-section, is received in an opening of matching shape 33 formed within a cam 32. Cam 32 is actually formed of two cylinders, respectively 34 and 36, separated from each other by a linear portion.

Cylinder 36 cooperates with previously-described rectilinear port 31.

Output shaft 22 of geared motor 20, 21 in fact cooperates with cylinder 34 of cam 32, said cylinder 34 crossing lateral wall 12 through a port 35 in the shape of an arc of a circle.

It should thus be understood that when reducer 21, actuated by motor 20, rotates output shaft 22, it generates the rotation of cam 32. Due to the cooperation thereof with cam race 31, the rotation of cam 32 causes the relative displacement of the lower end of flap 10, in the form of a pivoting thereof around its swivel axis 14. Flap 10 which pivots around its swivel axis 14 is thus motor-driven.

As a corollary, the electric power supply of motor 20 may be provided by means of an electronic board 40, secured in the other lateral wall 13, and electrically powered by means of a connector 41 emerging at the level of a through port 42 provided for this purpose at the upper end of the volume defined by lateral wall 13. Connector 41 cooperates with a connector of complementary shape (not shown), integrated at the level of the massage head.

Due to the use of such an electronic board 40, it can actually be envisaged to provide any sort of operating sequence of flap 10, according to the envisaged treatment. It is in particular possible to adjust the pivoting speed and the flapping frequency of the flap(s).

As already mentioned hereabove, the massage head is formed of two modules 2, 3 capable of being reversibly fastened to each other. For this purpose, each of the modules comprises, on the one hand, in the upper portion and, on the other hand, in the lower portion of the lateral walls, mechanical fastening means, respectively male 50 and 51, and female 52 and 53.

Figure 6:
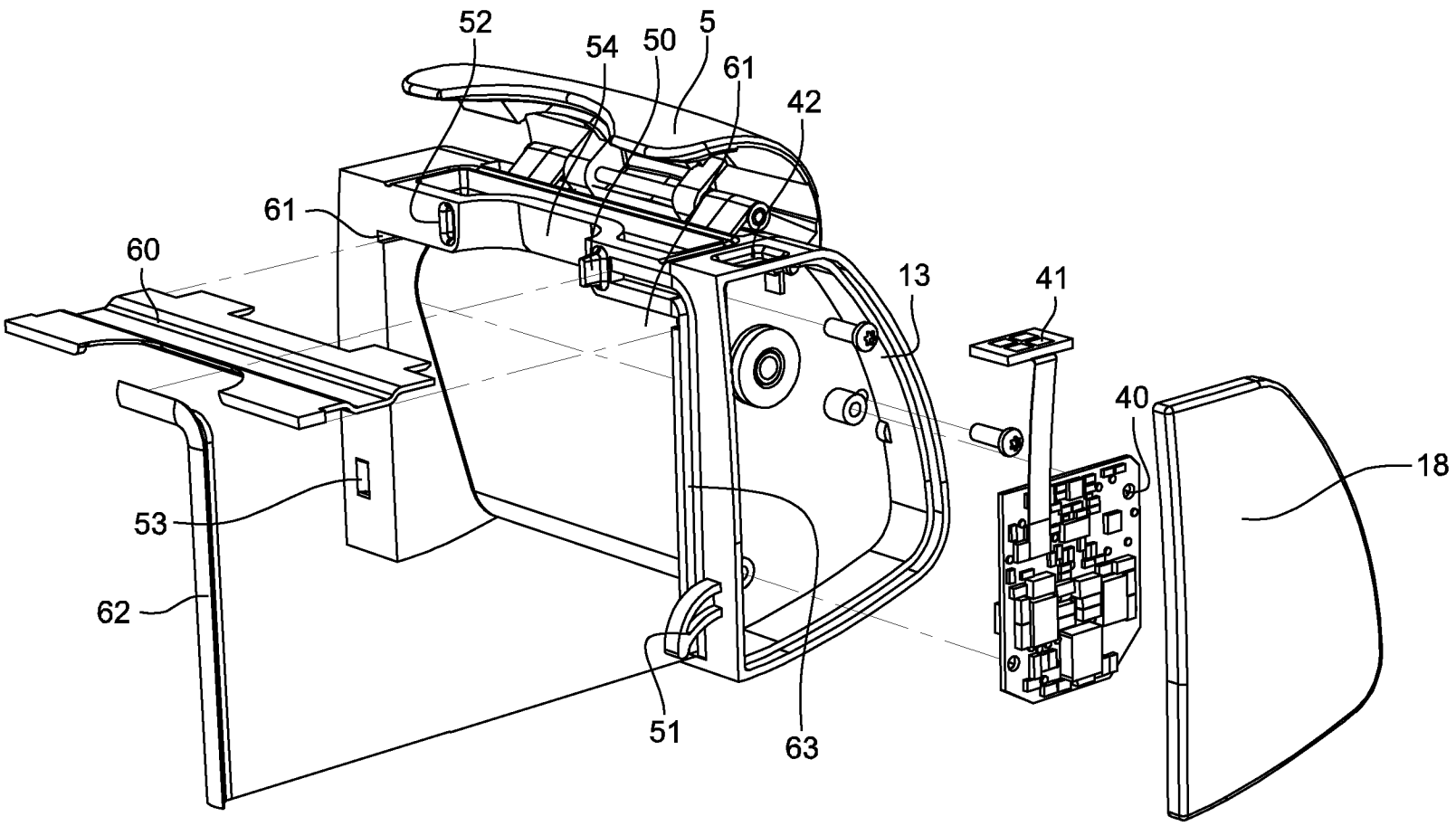
FIG. 6 is a simplified perspective view of said massage half-head, mainly illustrating the electric power supply of the geared motor integrated in the flap.

At the same time, when the massage head is assembled on a massage device provided with a suction source, the assembling together of the modules defines an opening 54, having the area of communication with the depression source emerging at its level. In such a configuration, and to optimize the tightness to promote the forming of the skinfold, the upper end of the internal chamber defined by the massage head is provided with a flap 60, received in housings 61 formed at the level of the internal side of lateral walls 12 and 13, as shown in FIG. 6. To promote the tightness within the internal chamber, the mating surfaces of each of modules 2, 3 are provided with a sealing gasket 62, received in a housing 63 provided for this purpose.

As already indicated, at least one of the flaps is motor-driven. However, according to an advantageous embodiment, the two transverse walls defining with the lateral walls the internal chamber of the massage head are each formed of a motor-driven flap, of the type previously described.

It should be understood that the use of such flaps, motor-driven by means of a geared motor integrated within one or each of the two flaps, provides a decisive optimization of the pinching action thereof on the skinfold, independently from any depression source. The forming of the skinfold is thus promoted. Further, lifting effects can be performed on the treated skin since, simultaneously to the pinching of the skin between the flaps, that is, when they are close to each other, a traction is induced on the skinfold thus pinched, thereby enabling to work the skin elasticity, tonicity, and firmness.

Due to these different means, a much more efficient mechanization action on the skin tissue is achieved, particularly to firm up the skin, to drain and reduce fat mass volumes, than prior art devices.

The invention claimed is:

1. A massage head comprising a casing defining an internal chamber configured to have a skinfold formed therein when the massage head is applied to a patient's skin, said fold configured to come into contact with the lower edges of the chamber, said chamber being defined by two lateral walls and by two transverse walls, at least one of said transverse walls being formed of a flap capable of having a pivoting motion, to induce the coming closer and the drawing away from each other of the lower edges of said transverse walls configured to be in contact with the skinfold:

wherein said at least one flap is hinged in the vicinity of its upper end on the lateral walls; and wherein the pivoting of the flap is obtained by means of a geared motor fixedly assembled within said flap, an output shaft of said geared-motor rotating a cam, received in a cam race rigidly attached to one of the lateral walls of the internal chamber.

2. The massage head of claim 1, wherein the free lower edge of the flap(s) is coated with a material having a high friction coefficient.

3. The massage head of claim 1, wherein a lateral wall opposite to that receiving the cam races receives an electronic board connected to a connector, accessible at the level of the upper end of said lateral wall.

4. The massage head of claim 1, wherein said head is formed of two modules, provided with means capable of enabling to reversibly fasten them to each other.

5. The massage head of claim 1, wherein said head receives a sealing shutter in the upper portion of the internal chamber defined in said head, said shutter being lodged in housings provided for this purpose.

6. The massage device of claim 1, wherein the free lower edge of the flap(s) is coated with elastomer.

7. A massage device comprising:

a massage head comprising a casing defining an internal chamber configured to have a skinfold formed therein when the massage head is applied to a patient's skin, said fold configured to come into contact with the lower edges of the chamber, said chamber being defined by two lateral walls and by two transverse walls, at least one of said transverse walls being formed of a flap capable of having a pivoting motion, to induce the coming closer and the drawing away from each other of the lower edges of said transverse walls configured to be in contact with the skinfold: wherein said at least one flap is hinged in the vicinity of its upper end on the lateral walls; and wherein the pivoting of the flap is obtained by means of a geared motor fixedly assembled within said flap, an output shaft of said geared-motor rotating a cam, received in a cam race rigidly attached to one of the lateral walls of the internal chamber; and an electric power source capable of actuating a motor actuating a reducer of the geared-motor.

8. The massage device of claim 7, wherein said device comprises a vacuum or depression source associated with the massage head, and emerging into the massage head.

* * * * *